US007109982B2

(12) United States Patent
Kim et al.

(10) Patent No.: US 7,109,982 B2
(45) Date of Patent: Sep. 19, 2006

(54) DISPLAY PANEL AND DRIVING METHOD THEREOF

(75) Inventors: Keum-Nam Kim, Suwon-si (KR); Ul-Ho Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/952,894

(22) Filed: Sep. 28, 2004

(65) Prior Publication Data

US 2005/0093787 A1 May 5, 2005

(30) Foreign Application Priority Data

Oct. 29, 2003 (KR) ..... 10-2003-0075990

(51) Int. Cl.
*G09G 3/30* (2006.01)

(52) U.S. Cl. ..... 345/208; 345/82; 345/76; 345/204

(58) Field of Classification Search ..... 345/76–82, 345/87–103, 208–210, 204–205; 315/169.1, 315/169.3; 348/800–803
See application file for complete search history.

(56) References Cited

U.S. PATENT DOCUMENTS 5,426,447 A * 6/1995 Lee ..... 345/103
5,510,807 A 4/1996 Lee et al.
5,686,936 A * 11/1997 Maekawa et al. ..... 345/100
5,708,454 A 1/1998 Katoh et al.
6,229,506 B1 5/2001 Dawson et al.
6,229,508 B1 * 5/2001 Kane ..... 345/82
6,362,798 B1 3/2002 Kimura et al.
6,369,786 B1 * 4/2002 Suzuki ..... 345/77
6,580,408 B1 6/2003 Bae et al.
6,650,060 B1 11/2003 Okuda
6,731,266 B1 * 5/2004 Jung ..... 345/103
6,760,005 B1 * 7/2004 Koyama et al. ..... 345/98
6,809,482 B1 10/2004 Koyama
2002/0047581 A1 4/2002 Koyama
2002/0118150 A1 8/2002 Kwon
2004/0041769 A1 3/2004 Yamashita et al.

(Continued)

FOREIGN PATENT DOCUMENTS

EP 0 905 673 A1 3/1991

(Continued)

OTHER PUBLICATIONS

European Search Report, Application No. EP 03 00 6113; Jan. 18, 2005, 2 pages.

*Primary Examiner*—Lun-Yi Lao
(74) *Attorney, Agent, or Firm*—Christie, Parker and Hale, LLP

(57) ABSTRACT

An organic electroluminescent (EL) display panel which includes a pixel circuit is provided. The pixel circuit includes a first transistor, a second transistor, and a display element. The first transistor has control and main electrodes and outputs a current which corresponds to a voltage charged in at least one capacitor being provided between the control and main electrodes. The second transistor has a second control electrode coupled to the control electrode of the first transistor. The second electrode is diode-connected. The display element displays image data corresponding to an amount of the current output by the first transistor. The first transistor and the display element are electrically decoupled during the first period for applying a pre-charge voltage to the control electrode of the first transistor and the second period for applying the data voltage to the control electrode of the first transistor.

19 Claims, 3 Drawing Sheets

U.S. PATENT DOCUMENTS

2004/0217925 A1* 11/2004 Chung et al. ..... 345/76

FOREIGN PATENT DOCUMENTS

EP 1 220 191 A2 7/2002
EP 1 220 191 A3 9/2003
JP 02082295 A 3/1990

* cited by examiner

DISPLAY PANEL AND DRIVING METHOD THEREOF

CROSS REFERENCE TO RELATED APPLICATION

This application claims priority to and the benefit of Korea Patent Application No. 2003-75990 filed on Oct. 29, 2003 in the Korean Intellectual Property Office, the entire content of which is incorporated herein by reference.

BACKGROUND OF THE INVENTION (a) Field of the Invention

The present invention relates to a display panel and a driving method thereof. More specifically, the present invention relates to an organic electroluminescent (EL) display panel and a driving method thereof.

(b) Description of the Related Art

In general, an organic electroluminescent (EL) display electrically excites a phosphorous organic compound to emit light. A light emitting pixel includes an anode (ITO), an organic thin film, and a cathode layer (metal). The organic thin film has a multi-layer structure including an emitting layer (EML), an electron transport layer (ETL), and a hole transport layer (HTL) for maintaining balance between electrons and holes and improving emitting efficiencies. Further, the organic emitting cell includes an electron injecting layer (EIL) and a hole injecting layer (HIL).

The organic emitting cells are arranged in an N×M matrix format to configure an organic EL display panel which displays image data by voltage- or current-driving.

FIG. 1 shows a brief diagram of a general organic EL display. Exemplary embodiments of the present invention can be applied to the EL display of FIG. 1, as well as other suitable displays.

As shown, the organic EL display includes an organic EL display panel 10, a scan driver 20, and a data driver 30.

The organic EL display panel 10 includes a plurality of data lines $D_1$ to $D_M$ arranged in the row direction, a plurality of scan lines $S_1$ to $S_N$ arranged in the column direction, and a plurality of pixel circuits 11. The data lines $D_1$ to $D_M$ provide data voltages for displaying image signals to the pixel circuits 11, and the scan lines $S_1$ to $S_N$ provide select voltages for selecting the pixel circuits 11 to the pixel circuits 11. The pixel circuits 11 are formed at pixel areas defined by two neighboring data lines and two neighboring scan lines.

The scan driver 20 sequentially applies the select signals to the scan lines $S_1$ to $S_N$, and the data driver 30 applies the data voltages for displaying the image signals to the data lines $D_1$ to $D_M$.

Methods for driving the organic emitting cells through the pixel circuits 11 include a passive matrix method and an active matrix method which uses thin-film transistors (TFTs). The passive matrix method includes forming anodes and cathodes arranged perpendicular to each other, selecting lines, and driving the organic emitting cells. The active matrix method includes using the TFTs to select lines, storing data in capacitors of the pixels, and driving the organic emitting cells.

The active matrix method includes a voltage programming method and a current programming method according to patterns of signals applied to maintain the voltage at a capacitor. The current programming method supplies a data current for representing gray scales to pixel circuits to display the image, and the voltage programming method supplies a data voltage for representing gray scales to the pixel circuits to display the image.

The current programming method fails to obtain a charge time for charging loads of data lines since it controls an organic EL element by using a fine current, and accordingly, the voltage programming method is generally used.

Regardless of whether the programming methods are voltage or current, an organic EL element may emit light that is not intended because of undesired current during programming of the data in the pixel circuits, and, thus, normal black levels may not be properly represented.

SUMMARY OF THE INVENTION

It is an aspect of the present invention to provide a display panel and a driving method thereof for properly representing black levels by compensating for a threshold voltage of a driving transistor and preventing a current flow to a display element during a pre-charge process.

In an exemplary embodiment according to the present invention, a method for driving a display panel is provided. The display panel includes a pixel circuit that has a first transistor having a control electrode and a main electrode and outputting a current which corresponds to a voltage charged in at least one capacitor being provided between the control and main electrodes, a second transistor having a control electrode coupled to the control electrode of the first transistor and being diode-connected, a third transistor for applying a data voltage provided by a data line to the second transistor, and a display element for displaying image data corresponding to an amount of the current output by the first transistor. The method includes applying a pre-charge voltage to the control electrode of the first transistor in response to a first control signal during a first period, interrupting application of the pre-charge voltage to the control electrode of the first transistor during a second period, applying the data voltage to the control electrode of the first transistor through the second transistor in response to a second control signal during a third period, and interrupting application of the data voltage to the control electrode of the first transistor during a fourth period. The first transistor and the display element are electrically decoupled during at least part of the first to fourth period.

The first control signal may be a select signal provided by a previous scan line. The first transistor and the display element may be electrically decoupled in response to a select signal provided by a previous scan line during the first period. The second control signal may be a select signal provided by a current scan line. In addition, the first transistor and the display element may be electrically decoupled in response to a select signal provided by a current scan line during the second period.

The first transistor and the display element may be electrically decoupled during the first and third periods. The pixel circuit may include a fourth transistor for applying the pre-charge voltage to the control electrode of the first transistor in response to a first control signal before the data voltage is applied. The pixel circuit may further include a fifth transistor for electrically decoupling the first transistor and the display element.

In another exemplary embodiment according to the present invention, a method for driving an organic EL display panel is provided. The display panel includes a pixel circuit that has a first transistor, having a control electrode and a main electrode, at least one capacitor being provided between the control electrode and the main electrode, the first transistor outputting a current which corresponds to a voltage charged in the capacitor, a second transistor having a control electrode coupled to the control electrode of the first transistor and being diode-connected, and a display element for displaying image data corresponding to an amount of the current output by the first transistor. The method includes applying a pre-charge voltage to the control electrode of the first transistor in response to a select signal provided by a previous scan line during a first period, interrupting application of the pre-charge voltage to the control electrode of the first transistor during a second period, applying a data voltage to the control electrode of the first transistor through the second transistor in response to a select signal provided by a current scan line during a third period, and interrupting application of the data voltage to the control electrode of the first transistor during a fourth period. The first transistor and the display element are electrically decoupled during the first and third periods.

The pixel circuit may also include a third transistor for applying the pre-charge voltage to the control electrode of the first transistor in response to a first control signal before the data voltage is applied. The pixel circuit may further include a fourth transistor for electrically decoupling the first transistor and the display element.

In still another exemplary embodiment according to the present invention, an organic EL display panel is provided. The orgainic EL display panel includes a plurality of data lines for applying a data voltage for displaying a image signal, a plurality of scan lines for providing a select signal, and a plurality of pixel circuits respectively formed at pixel regions defined by two adjacent data lines and two adjacent scan lines.

At least one pixel circuit of the plurality of pixel circuits includes a display element for displaying image corresponding to an amount of an applied current, a first transistor having a control electrode and a main electrode, a capacitor being provided between the control electrode and the main electrode, the first transistor outputting a current which corresponds to a voltage between the control electrode and the main electrode, a second transistor having a control electrode coupled to the control electrode of the first transistor, and being diode-connected, a first switch coupled to a main electrode of the second transistor, and applying a data voltage provided by at least one data line of the plurality of data lines to the second transistor in response to a select signal provided by a current scan line, a second switch for applying a pre-charge voltage to the control electrode of the first transistor in response to a first control signal before the data voltage is applied, and a third switch for electrically decoupling the first transistor and the display element by being turned off in response to a second control signal. The first transistor and the display element are electrically decoupled while the data voltage is applied to the control electrode of the first transistor through the second transistor after the pre-charge voltage is applied to the control electrode of the first transistor.

BRIEF DESCRIPTION OF THE DRAWINGS

The accompanying drawings, together with the specification, illustrate exemplary embodiment(s) of the present invention, and, together with the description, serve to explain the principles of the present invention.

DETAILED DESCRIPTION

In the following detailed description, only certain exemplary embodiment(s) of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

Figure 1:
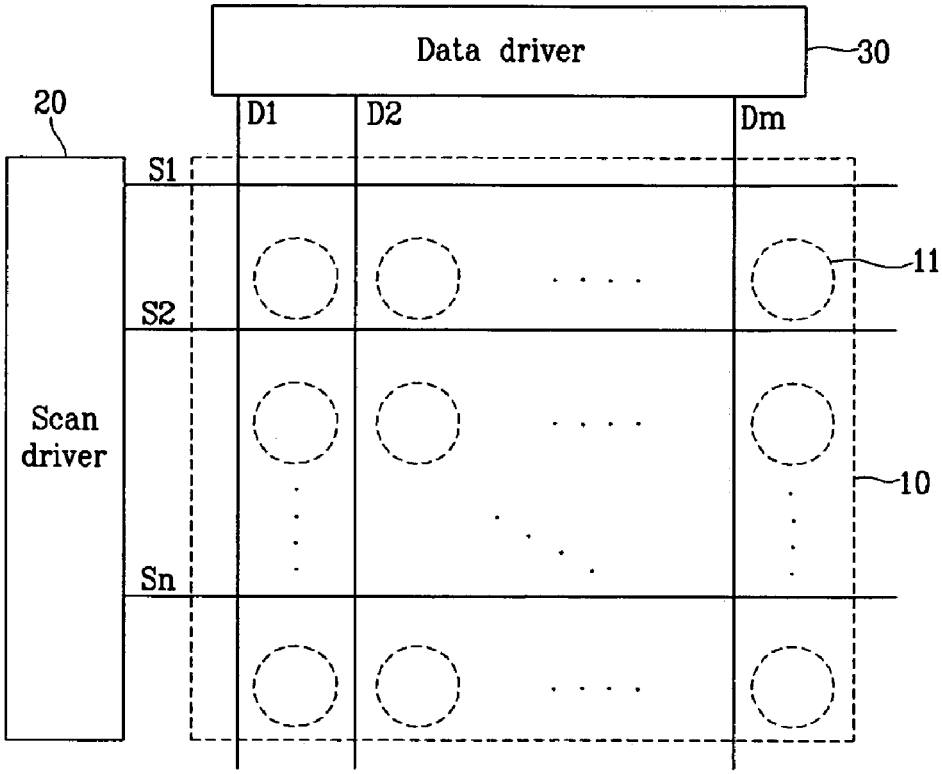
FIG. 1 shows a diagram for a general organic electroluminescent (EL) display panel, to which exemplary embodiments of the present invention can be applied.
Figure 2:
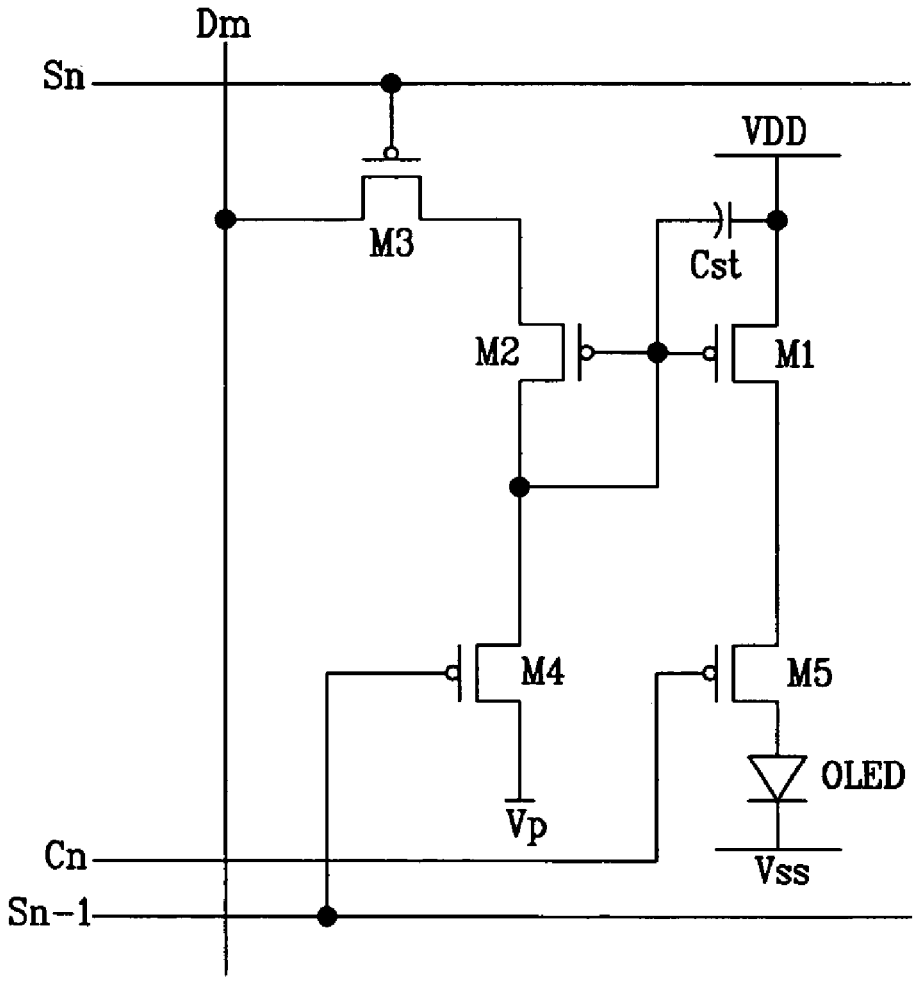
FIG. 2 shows an equivalent circuit of a pixel circuit for driving respective display cells on the organic EL display panel of FIG. 1.

FIG. 2 shows an equivalent circuit diagram of the pixel circuit 11 of FIG. 1 for driving the respective display panels of the organic EL display panel.

For ease of description in FIG. 2, the pixel circuit coupled to the $m^{th}$ data line $D_m$ and the $n^{th}$ scan line $S_n$ is illustrated. Further, in the context of the following discussions, a scan line which is transmitting the current select signal is referred to as a "current scan line," and a scan line which transmitted the select signal before the current select signal is transmitted is referred to as a "previous scan line."

As shown in FIG. 2, the pixel circuit 11 includes an organic EL element (OLED), transistors M1, M2, M3, M4, M5, and a capacitor Cst. The transistors M1, M2, M3, M4, M5 can be realized with PMOS transistors, and the transistors M1, M2, M3, M4 and M5 should include TFTs each having a gate electrode, a drain electrode, and a source electrode formed on a glass substrate of the display panel 10 as a control electrode and two main electrodes. The scope of the present invention, however, is not limited to the channel type of the transistors M1, M2, M3, M4, M5. Instead, all or some of the transistors can be replaced by any suitable active element which has a first terminal, a second terminal, and a third terminal, and control the current flowing to the third terminal from the second terminal according to a voltage applied between the first and second terminals (e.g., an NMOS transistor or transistors). Of course, those skilled in the art would recognize that the voltage polarities and levels may be different when other active elements are used.

The driving transistor M1 has a source coupled to a power supply voltage source VDD. The driving transistor also has a gate. A capacitor Cst is coupled between the gate and the source of the transistor M1.

The capacitor Cst maintains a gate-source voltage $V_{GS}$ of the transistor M1 for a predetermined time.

The compensation transistor M2 is diode-connected, and a gate of the compensation transistor M2 is coupled to the gate of the driving transistor M1.

The switching transistor M3 applied the data voltage provided by the data line $D_m$ to the compensation transistor M2 in response to the select signal provided by the current scan line $S_n$. A drain of the compensation transistor M2 is coupled to a pre-charge transistor M4.

The transistor M4 applied a pre-charge voltage $V_p$ to the compensation transistor M2 in response to the select signal provided by the previous scan line $S_{n-1}$.

The transistor M5 is coupled between the drain of the driving transistor M1 and an anode of the organic EL element (OLED). The transistor M5 can be realized with a PMOS transistor in the same manner as the transistors M1 to M4. Further, transistor M5 decouples the driving transistor M1 and the organic EL element (OLED) in response to a high-level control signal provided by a control line $C_n$.

The organic EL element (OLED) has a cathode coupled to a reference voltage source $V_{SS}$, and emits light corresponding to the applied current. The voltage level of the reference voltage source $V_{SS}$ is less than the voltage level of the power supply voltage source VDD. The voltage level of the voltage source $V_{SS}$ may include a ground voltage level.

Figure 3:
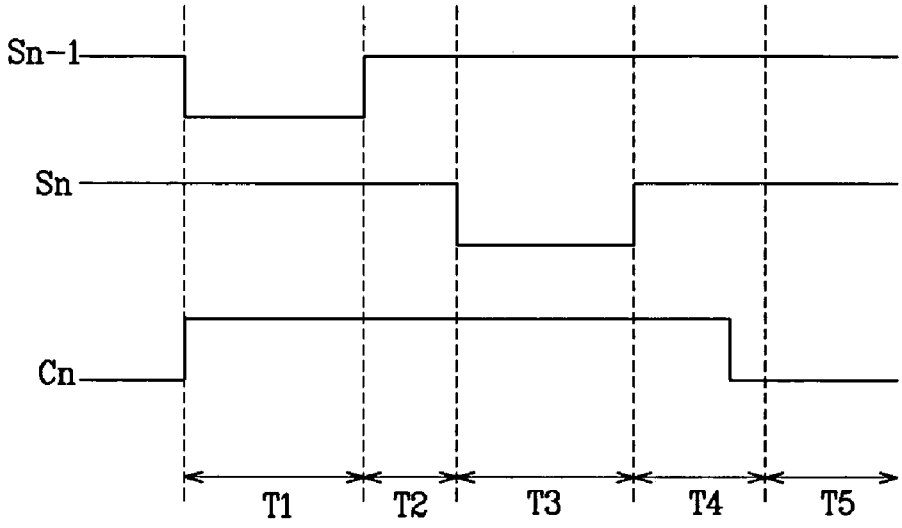
FIG. 3 shows a driving waveform diagram for driving the pixel circuit of FIG. 2.

FIG. 3 shows a signal waveform of a control signal applied to the control line $C_n$ so as to drive the pixel circuit shown in FIG. 2.

As shown, during the pre-charge period of T1, a select signal provided by the previous scan line $S_{n-1}$ is switched to a low level (L) to turn on the transistor M4, and a control signal provided by the control line $C_n$ is switched to a high level (H) to turn off the transistor M5. The pre-charge voltage $V_p$ is applied to the gate of the driving transistor M1 by the turned-on transistor M4. In this instance, it is desirable for the pre-charge voltage $V_p$ to be a little less than a voltage which is applied to the gate of the transistor M1 so as to reach the maximum gray level, that is, the lowest data voltage applied through the data line $D_m$. Hence, the data voltage should always be greater than the gate voltage of the transistor M2 when the data voltage is applied through the data line $D_m$. That is, the transistor M2 is coupled in the forward direction, and the data voltage is charged in the capacitor Cst.

In this instance, the gate-source voltage $V_{GS}$ maintained by the capacitor Cst is increased by the pre-charge voltage $V_p$, and a large current may flow to the transistor M1. When the current is supplied to the organic EL element (OLED), the organic EL element (OLED) emits light, and it fails to represent accurate black gray scales. However, in the present invention, the transistor M1 and the organic EL element (OLED) are electrically decoupled by the turned-off transistor M5, and no current by the pre-charge voltage of $V_p$ flows. Therefore, the accurate black gray scales are represented, the unneeded current flow is prevented, and power consumption is also reduced.

Next, during the blanking period of T2, while the select signal provided by the current scan line $S_n$ is maintained at the high level (H), and the control signal provided by the control line $C_n$ is also maintained at the high level (H), the select signal provided by the previous scan line $S_{n-1}$ is switched to the high level (H) to turn off the transistor M4. The data voltage provided by the data line $D_m$ is modified to a data voltage which corresponds to the pixel circuit coupled to the current scan line $S_n$ during this period of T2. If no blanking period of T2 is provided, the previous data voltage applied to the data line $D_m$ is applied to the transistor M1 through the transistor M3 when the select signal provided by the current scan line $S_n$ is switched to a low level (L) before the current data voltage is applied.

Next, during the data charging period of T3, the select signal provided by the current scan line $S_n$ is switched to a low level (L) to turn on the transistor M3 while the control signal provided by the control line $C_n$ is maintained at the high level (H), and the select signal provided by the previous scan line $S_{n-1}$ is maintained at the high level (H). The data voltage provided by the data line $D_m$ is applied to the transistor M2 through the transistor M3. Since the transistor M2 is diode-connected, a voltage which corresponds to the difference between the data voltage and a threshold voltage $V_{TH2}$ of the transistor M2 is applied to the gate of the transistor M1. The voltage is charged in the capacitor Cst and maintained for a predetermined time. The transistor M5 is maintained at the turned-off state since the select signal provided by the control line $C_n$ is high level (H).

During the blanking period of T4, the select signal provided by the current scan line $S_n$ is maintained at the high level (H), and the control signal provided by the control line $C_n$ is maintained at the high level (H) during part of the blanking period of T4. The select signal provided by the previous scan line $S_{n-1}$ is switched to the high level (H) to turn off the transistor M4. The data voltage provided by the data line $D_m$ in this period of T4 is modified to a data voltage which corresponds to the pixel circuit coupled to the current scan line $S_n$. It is desirable to modify the data voltage to a data voltage which is to be applied to the actual pixel circuit.

During the emitting period of T5, $C_n$ is at a low level (L) and the transistor M5 is on. A current $I_{OLED}$ corresponding to the gate-source voltage $V_{GS}$ of the transistor M1 is supplied to the organic EL element (OLED) to thus allow the organic EL element to emit light.

As described, the transistor M1 and the organic EL element (OLED) are electrically decoupled and no current by the pre-charge voltage $V_p$ flows, because of the transistor M5 which is continuously turned off during the pre-charge period of T1, the blanking period of T2, the data charging period of T3, and a part of the blanking period of T4. Therefore, accurate black gray scales are substantially represented, flow of undesired or leakage currents (e.g., caused by the pre-charge voltage) is substantially prevented while charging the data, and the power consumption is substantially reduced.

The organic EL display panel is exemplified in the above-described embodiment(s), and in addition, the present invention is also applicable to other types of light emitting display devices which emit light according to a current.

While this invention has been described in connection with certain exemplary embodiment(s), it is to be understood that the invention is not limited to the disclosed embodiment(s), but, on the contrary, is intended to cover various modifications included within the spirit and scope of the appended claims and equivalents thereof.

What is claimed is:

1. A method for driving a display panel including a pixel circuit, the pixel circuit including a first transistor, a second transistor, a third transistor, and a display element, the first transistor having a control electrode and a main electrode and outputting a current which corresponds to a voltage charged in at least one capacitor provided between the control electrode and the main electrode, the second transistor having a second control electrode coupled to the control electrode of the first transistor and being diode-connected, the third transistor applying a data voltage provided by a data line to the second transistor, the display element displaying image data corresponding to an amount of the current output by the first transistor, the method comprising:

applying a pre-charge voltage to the control electrode of the first transistor in response to a first control signal during a first period;

interrupting application of the pre-charge voltage to the control electrode of the first transistor during a second period;

applying the data voltage to the control electrode of the first transistor through the second transistor in response to a second control signal during a third period; and interrupting application of the data voltage to the control electrode of the first transistor during a fourth period, wherein the first transistor and the display element are electrically decoupled during at least part of the fourth period.

2. The method of claim 1, wherein the first control signal comprises a select signal provided by a previous scan line.

3. The method of claim 1, wherein the second control signal comprises a select signal provided by a current scan line.

4. The method of claim 1, wherein the first control signal comprises a select signal provided by a previous scan line, the first transistor and the display element are electrically decoupled in response to the select signal provided by the previous scan line during the first period, the second control signal comprises a second select signal provided by a current scan line, and the first transistor and the display element are electrically decoupled in response to the second select signal provided by the current scan line during the second period.

5. The method of claim 1, wherein the first transistor and the display element are electrically decoupled during the first and third periods.

6. The method of claim 1, wherein the pixel circuit comprises a fourth transistor for applying the pre-charge voltage to the control electrode of the first transistor in response to the first control signal before the data voltage is applied.

7. The method of claim 6, wherein the pixel circuit comprises a fifth transistor for electrically decoupling the first transistor and the display element.

8. The method of claim 1, wherein the pixel circuit comprises a fourth transistor for electrically decoupling the first transistor and the display element.

9. The method of claim 1, where the first transistor and the display element are electrically coupled during a fifth period.

10. A method for driving an organic EL (electroluminescent) display panel including a pixel circuit, the pixel circuit including a first transistor, a second transistor, and a display element, the first transistor having a control electrode and a main electrode, at least one capacitor being provided between the control electrode and the main electrode, the first transistor further outputting a current which corresponds to a voltage charged in the capacitor, the second transistor having a control electrode coupled to the control electrode of the first transistor and being diode-connected, the display element displaying data corresponding to an amount of the current output by the first transistor, the method comprising:

applying a pre-charge voltage to the control electrode of the first transistor in response to a select signal provided by a previous scan line during a first period;

interrupting application of the pre-charge voltage to the control electrode of the first transistor during a second period;

applying a data voltage to the control electrode of the first transistor through the second transistor in response to a select signal provided by a current scan line during a third period; and interrupting application of the data voltage to the control electrode of the first transistor during a fourth period, wherein the first transistor and the display element are electrically decoupled during the first and third periods.

11. The method of claim 10, wherein the pixel circuit comprises a third transistor for applying the pre-charge voltage to the control electrode of the first transistor in response to the select signal before the data voltage is applied.

12. The method of claim 11, wherein the pixel circuit comprises a fourth transistor for electrically decoupling the first transistor and the display element.

13. The method of claim 10, wherein the pixel circuit comprises a third transistor for applying the data voltage provided by a data line to the second transistor.

14. The method of claim 13, wherein the pixel circuit comprises a fourth transistor for applying the pre-charge voltage to the control electrode of the first transistor in response to the select signal before the data voltage is applied.

15. The method of claim 14, wherein the pixel circuit comprises a fifth transistor for electrically decoupling the first transistor and the display element.

16. The method of claim 10, wherein the pixel circuit comprises a third transistor for electrically decoupling the first transistor and the display element during the first and third periods.

17. The method of claim 10, wherein the first transistor and the display element are electrically decoupled during the second period.

18. The method of claim 17, wherein the first transistor and the display element are electrically decoupled during at least part of the fourth period.

19. The method of claim 18, wherein the first transistor and the display element are electrically coupled during a fifth period.

* * * * *